US005494108A

United States Patent [19]

Palmer et al.

[11] Patent Number: 5,494,108

[45] Date of Patent: Feb. 27, 1996

[54] METHOD FOR STIMULATING A COAL SEAM TO ENHANCE THE RECOVERY OF METHANE FROM THE COAL SEAM

[75] Inventors: Ian D. Palmer, Tulsa, Okla.; Paul Edwards, NorthGlenn, Colo.

[73] Assignee: Amoco Corporation, Chicago, Ill.

[21] Appl. No.: 451,964

[22] Filed: May 26, 1995

Related U.S. Application Data

[63] Continuation of Ser. No. 250,561, May 27, 1994, Pat. No. 5,419,396, which is a continuation-in-part of Ser. No. 174, 303, Dec. 29, 1993, Pat. No. 5,417,286.

[51] Int. Cl.[6] ..... E21B 43/25

[52] U.S. Cl. ..... 166/308; 166/305.1; 299/16

[58] Field of Search ..... 166/305.1, 308; 299/12, 16

[56] References Cited

U.S. PATENT DOCUMENTS

| | | | |
|---|---|---|---|
| 3,108,636 | 10/1963 | Peterson . | |
| 3,384,416 | 5/1968 | Ruehl | 299/16 |
| 3,814,480 | 6/1974 | Dahl et al. | 299/308 |
| 4,043,395 | 8/1977 | Every et al. | 166/263 |
| 4,245,699 | 1/1981 | Steeman | 166/308 |
| 4,283,089 | 8/1981 | Mazza et al. | 299/308 |
| 4,400,034 | 8/1983 | Chew | 299/5 |
| 4,446,921 | 5/1984 | Coenen et al. | 166/267 |
| 4,544,037 | 10/1985 | Terry | 166/369 |
| 4,756,367 | 7/1988 | Puri et al. | 166/263 |
| 4,883,122 | 11/1989 | Puri et al. | 166/263 |
| 4,913,237 | 4/1990 | Kutas | 166/308 |
| 5,014,785 | 5/1991 | Puri et al. | 166/263 |
| 5,014,788 | 5/1991 | Puri et al. | 166/308 |
| 5,085,274 | 2/1992 | Puri et al. | 166/252 |
| 5,099,921 | 3/1992 | Puri et al. | 166/266 |
| 5,133,406 | 7/1992 | Puri | 166/266 |
| 5,147,111 | 9/1992 | Montgomery | 299/16 |
| 5,199,766 | 4/1993 | Montgomery | 299/16 |

FOREIGN PATENT DOCUMENTS 609917 6/1978 U.S.S.R. .

OTHER PUBLICATIONS

R. S. Metcalfe, D. Yee, J. P. Seidle, and R. Puri, "Review of Research Efforts in Coalbed Methane Recovery", SPE 23025, (1991).

R. Puri and D. Yee, "Enhanced Coalbed Methane Recovery", SPE 20732, (1990).

Alan A. Reznik, Pramod K. Singh and William L. Foley, "An Analysis of the Effect of Carbon Dioxide Injection on the Recovery of In–Situ Methane from Bituminous Coal: An Experimental Simulation", SPE/DOE 10822, (1982).

A. V. Astakhov and D. L. Shirochin, "Capillary–Like Condensation of Sorbed Gases in Coals", *Fuel,* vol. 70, pp. 51–56, (Jan. 1991).

B. D. Hughes and T. L. Logan, "How to Design a Coalbed Methane Well",. *Petroleum Engineer Intenational,* pp. 16–20, (May 1990).

Paul F. Fulton, "A Laboratory Investigation of Enhanced Recovery of Methane from Coal by Carbon Dioxide Injection," SPE/DOE 8930, (1980).

Alan A. Reznik, et al., "Enhanced Recovery of In–Situ Methane by Carbon–Dioxide Injection: An Experimental Feasibility Study", a report by the Chemical and Petroleum Engineering Department, University of Pittsburgh, for the U.S. Department of Energy, Office of Fossil Energy, Morgantown Energy Technology Center, DOE/MC/14262–1732 (DE85003352), May 1982).

(List continued on next page.)

*Primary Examiner*—George A. Suchfield

*Attorney, Agent, or Firm*—Charles P. Wakefield; Robert E. Sloat

[57] ABSTRACT

A method is disclosed for increasing the methane recovery rate through a wellbore which penetrates a coal seam. The invention utilizes the cavitation of the coal seam surrounding the wellbore after a substantial percentage of the original methane-in-place which is available for recovery from the wellbore has been recovered from the coal seam.

13 Claims, 6 Drawing Sheets

OTHER PUBLICATIONS

Dan Yee, et al., "Gas Sorption on Coal and Measurement of Gas Content", *Hydrocarbons from Coal,* Chap. 9, pp. 203–218, The American Association of Petroleum Geologists, Tulsa, Oklahoma, (1993).
L. E. Arri, et al., "Modeling Coalbed Methane Production with Binary Gas Sorption", SPE 24363, (1992).
N. Ali, et al., "Injection Above–Parting–Pressure Waterflood Pilot, Valhall Field, Norway", SPE 22893, (1991).
Carl L. Schuster, "Detection Within the Wellbore of Seismic Signals Created by Hydraulic Fracturing", SPE 7448, (1978).
Ralph W. Veatch, Jr., Zissis A. Mosachovidis and C. Robert Fast, "An Overview of Hydraulic Fracturing", *Recent Advances in Hydraulic Fracturing,* vol. 12, Chapter 1, pp. 1–38, SPE Monograph Series, (1989).
N. R. Warpinski and Michael Berry Smith, "Rock Mechanics and Fracture Geometry", *Recent Advances in Hydraulic Fracturing,* vol. 12, Chapter 3, pp. 57–80, SPE Monograph Series, (1989).
T. L. Logan et al., "Optimizing and Evaluation of Open–Hole Cavity Completion Techniques for Coal Gas Wells", Proceedings of the 1993 International Coalbed Methane Symposium, The University of Alabama/Tuscaloosa, 9346 (May 1993).
R. G. Jeffrey et al., "Small–Scale Hydraulic Fracturing and Mineback Experiments in Coal Seams", Proceedings of the 1993 International Coalbed Methane Symposium, The University of Alabama/Tuscaloosa, 9330 (May 1993).
T. L. Logan et al., "Methane from Coal Seams Research", Quarterly Review of Methane from Coal Seam Technology, pp. 6–12, published by the Gas Research Institute (Apr. 1993).
S. D. Spafford et al., "Remedial Stimulation of Coalbed Methane Wells: A Case Study of Rock Creek Wells", Proceedings of the 1993 International Coalbed Methane Symposium, The University of Alabama/Tuscaloosa, 9374 (May 1993).
H. Morales et al., "Analysis of Coalbed Hydraulic Fracturing Behavior in the Bowen Basin (Australia)", Proceedings of the 1993 International Coalbed Methane Symposium, The University of Alabama/Tuscaloosa, 9349 (May 1993).
I. D. Palmer et al., "Sandless Water Fracture Treatments in Warrior Basin Coalbeds", Proceedings of the 1993 International Coalbed Methane Symposium, The University of Alabama/Tuscaloosa, 9355 (May 1993).
M. Khodaverdian et al., "Cavity Completions: A Study of Mechanisms and Applicability", Proceedings of the 1993 International Coalbed Methane Symposium, The University of Alabama/Tuscaloosa, 9336 (May 1993).
S. W. Lambert et al., "Warrior Basin Drilling, Stimulation Covered", *Oil & Gas Journal,* pp. 87–92 (Nov. 13, 1989).
T. L. Logan et al., "Hydraulic Fracture Stimulation and Openhole Testing of a Deeply Buried Coal Seam in the Piceance Basin, Colorado", SPE 15251 (1986).
I. D. Palmer et al., "Openhole Cavity Completions in Coalbed Methane Wells in the San Juan Bsin", Society of Petroleum Engineers, SPE 24906 (1992).
I. D. Palmer et al., "Review of Coalbed Methane Well Stimulation", SPE 22395 (1992).
I. D. Palmer et al., "Coalbed Methane Well Completions and Stimulations", Chapter 14, pp. 303–339; *Hydrocarbons from Coal,* published by the American Association of Petroleum Geologists (1993).
S. R. Daines, "Prediction of Fracture Pressures for Wildcat Wells", Society of Petroleum Engineers of AIME, pp. 863–872 (1982).
S. Harpalani, et al., "Influence of Matrix Shrinkage and Compressibility on Gas Production From Coalbed Methane Reservois", SPE 20729 (Sep. 1990).
Arfon H. Jones, et al., "A Review of the Physical and Mechyanical Properties of Coal with Implications for Coal–Bed Metane Well Completion and Production", pp. 169–181, *Coal–Bed Methane,* a publication of the Rocky Mountain Association of Geologists (1988).
H. H. Abass et al., "Experimental Observations of Hydraulaic Fracture Propagation Through Coal Blocks", SPE 21289 (Nov. 1990).
B. W. McDaniel, "Benefits and Problems of Minifrac Applications in Coalbed Methane Wells", pp. 103–104 through 103–116, Paper No. CIM/SPE 90–103, a publication of the Petroleum Society of CIM and the Society of Petroleum Engineers (1990).
Ian Gray, "Reservoir Engieering in Coal Seams: Part 1–The Physical Process of Gas Storage and Movement in Coal Seams", pp. 7–13, an article published by the Society of Petroleum Engineers (SPE) (1987).
M. B. Dusseault, "Fluid Injection Design to Preclude Induced Shear Failure of Formations", Paper No. 85–36–6, a paper presented at the 36th Annual Technical Meeting of the Petroleum Society of CIM in Edmonton, Canada (Jun. 1985).

METHOD FOR STIMULATING A COAL SEAM TO ENHANCE THE RECOVERY OF METHANE FROM THE COAL SEAM

RELATED APPLICATION

This is a continuation of application Ser. No. 08/250,561, filed May 27, 1994, now U.S. Pat. No. 5,419,396, which is a continuation-in-part of U.S. patent application Ser. No. 08/174,303, filed Dec. 29, 1993, and now U.S. Pat. No. 5,417,286.

FIELD OF THE INVENTION

The present invention relates to methods for increasing the methane recovery rate from a coal seam. More specifically, the present invention relates to methods which utilize the stimulation of a coal seam from which a substantial percentage of the original methane-in-place available to the wellbore has been recovered.

BACKGROUND OF THE INVENTION

Coal seams contain significant quantities of natural gas. This natural gas is composed primarily of methane. The rate of recovery of methane from coal seams typically depends on the rate at which gas can flow through the coal seam to a production well. The gas flow rate through a coal seam is affected by many factors including the matrix porosity of the coal, the permeability of the coal seam, the extent of the fracture system which exists within the coal seam, and the stress within the coal seam.

An unstimulated coal seam has a natural system of fractures, the smaller and most common ones being referred to as "cleats" or collectively as a "cleat system". To reach a wellbore, the methane must desorb from a sorption site on or within the coal matrix and diffuse to the cleat system. The methane travels along the cleat system and other fractures present within the coal seam to the wellbore where it is recovered.

Typically, the natural system of fractures within a coal seam does not provide for an acceptable methane recovery rate. In general, coal seams must be stimulated to enhance the recovery of methane from the seams. Typically, the stimulation is completed prior to placing a production well on-line to a gas gathering system.

Various techniques have been developed to stimulate coal seams. One example of a technique for stimulating the production of methane from a coal seam is to complete the production wellbore with an open-hole cavity. In this technique, a wellbore is drilled to a location above the coal seam to be stimulated. The wellbore is cased and the casing is cemented in place using a conventional drilling rig. A modified drilling rig is then used to drill an "open-hole" interval within the coal seam. An open-hole interval is an interval within the coal seam which has no casing set.

The open-hole interval can be completed by various methods. One method utilizes injection/blowdown cycles to create a cavity within the open-hole interval. In this method, air is injected into the open-hole interval and then released rapidly through a surface valve. Once a suitable cavity has been created, the modified drilling rig is removed from the wellbore and the production well is put into service. A metal liner, which has holes, may be placed in the open-hole interval if desired. The coal seam will be dewatered if necessary to improve the desorption of methane from the coal seam.

Generally, once a coal seam has been dewatered and a sufficient methane recovery rate is maintained from the production well, very little is done to the production wells or the coal seam other than to perform routine and preventative maintenance on the production equipment.

As used herein, the following terms shall have the following meanings:

(a) "coal seams" are carbonaceous formation which typically contain between 50 and 100 percent organic material by weight;

(b) "cleats" or "cleat system" is the natural system of fractures within a coal seam;

(c) "formation parting pressure" and "parting pressure" mean the pressure needed to open a coal seam and propagate ;an induced fracture through the coal seam;

(d) "reservoir pressure" means the pressure of a coal seam near a well during shut-in of that well;

(e) "recovery" means a controlled collection and/or disposition of a gas, such as storing the gas in a tank or distributing the gas through a pipeline. "Recovering" specifically excludes venting the gas into the atmosphere;

(f) "sorption" refers to a process by which a gas is held by a carbonaceous material, such as coal, which contains micropores. The gas typically is held on the coal in a condensed or liquid-like phase within the micropores, or the gas may be chemically bound to the coal;

(g) "original methane-in-place" means the quantity of methane sorbed to the carbonaceous material of the coal seam available to be drained by a wellbore penetrating the seam. The original methane-in-place is measured prior to the initial recovery of methane from the coal seam; and (h) "pore pressure cracking" is shear failure which is induced in weak formation, such as coal seams, by rapidly changing the pressure which is present within the micropores and the macropores of the carbonaceous matrix of the coal seam. Such failure will usually be accompanied by an increase in permeability of the coal seam.

SUMMARY OF THE INVENTION

It has been surprisingly discovered that the recovery rate of methane from a coal seam can be greatly increased by stimulating the coal seam after recovering a substantial percentage of the original methane-in-place. The substantial percentage of methane can be recovered by standard pressure depletion techniques or by injecting desorbing fluids such as nitrogen, air, carbon dioxide, or flue gas into the coal seam to desorb methane from the coal seam and cause it to move toward a production well where it can be recovered. Methods which utilize injected desorbing fluids to enhance the recovery of methane from a coal seam are sometimes hereinafter referred to as "enhanced coalbed methane recovery techniques." In the preferred embodiment of the invention, cavitation of the coal seam surrounding a production wellbore is carried out after a substantial percentage of the original methane-in-place available to the production wellbore has been removed from the coal seam.

It is believed that the removal of a substantial percentage of the original methane-in-place will allow tensile and shear failure to be more readily created within the coal seam. The additional failure which is created within the coal seam will increase the permeability of the coal seam and increase the methane recovery rate from the coal seam. In tests performed in the field, on production wells which were already producing methane at very high rates, it was surprisingly discovered that it is possible to recavitate a wellbore that was originally completed using an open-hole cavity technique, and that the recavitation was capable of providing an increased methane recovery rate of more than three times the pre-recavitation methane recovery rate.

DESCRIPTION OF THE EMBODIMENTS

Figure 1:
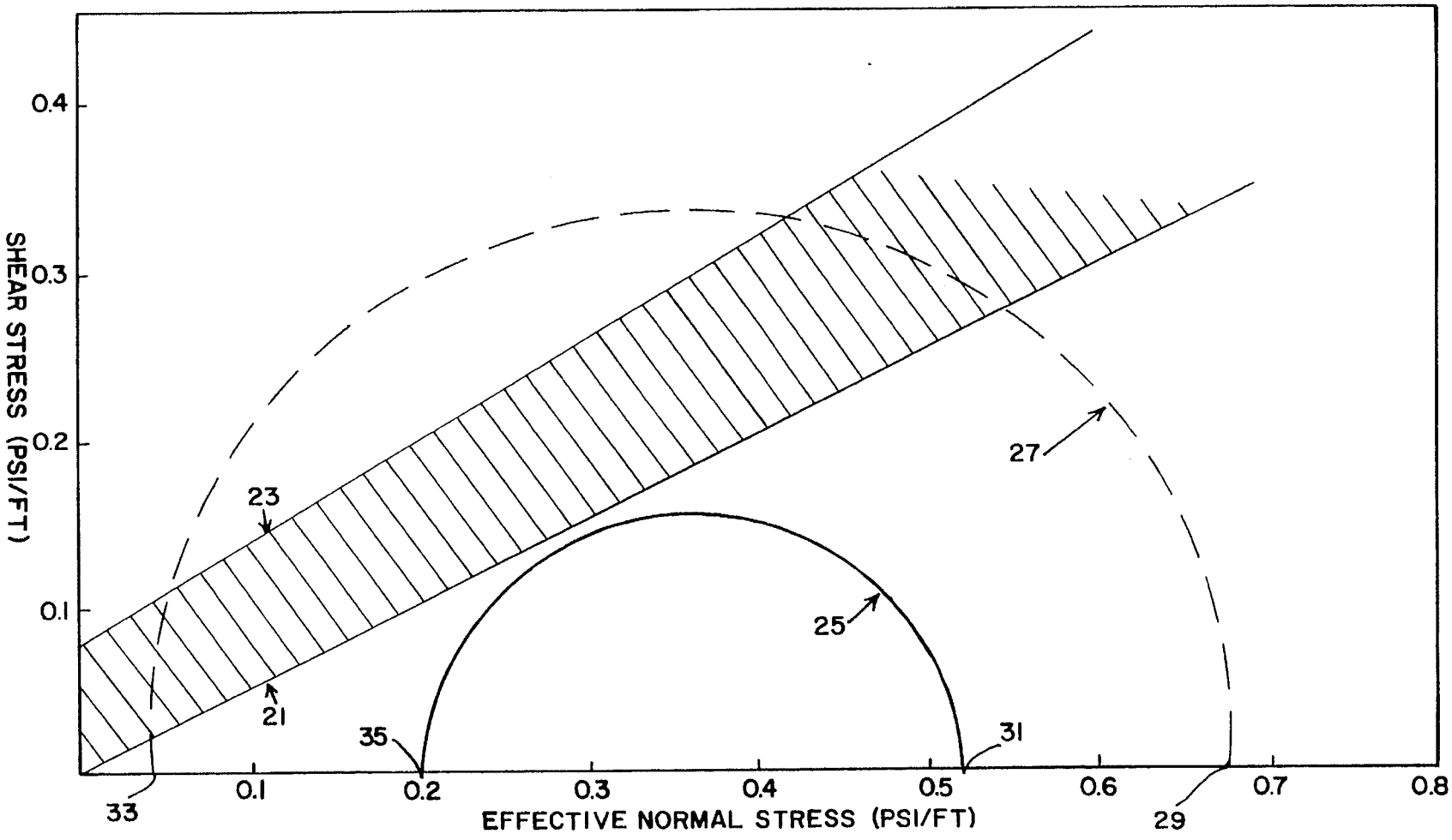
FIG. 1 is a graphical representation of the stresses associated with the failure of coal.

It has been surprisingly discovered that the methane recovery rate from a production well which is in fluid communication with a coal seam can be greatly increased by cavitating the coal seam surrounding the wellbore after recovering a substantial percentage of the original methane-in-place from the coal seam. Preferably, from 2 to 70 percent of the original methane-in-place available to the wellbore should be desorbed and recovered from the coal seam prior to cavitation; more preferably, from 7 to 50 percent of the original methane-in-place; most preferably, from 15 to 30 percent of the original methane-in-place. It has been further surprisingly discovered that the method is capable of greatly increasing the methane recovery rate from production wells that have been completed with open-hole cavitation techniques and that are already producing at a rate of greater than one million cubic feet of methane per day. Open-hole cavity completion wells which are producing greater that one million cubic feet of methane per day are considered very good wells which in the past would not be candidates for additional stimulation.

While it is not known why removing a substantial percentage of the original methane-in-place available to a wellbore prior to cavitating the coal seam surrounding the wellbore increases the methane recovery rate so dramatically, it is believed that it is at least in part a result of the matrix shrinkage which results when methane is desorbed from the matrix. It is believed that matrix shrinkage will facilitate pore pressure cracking within the coal seam during the practice of the invention. Since coal seams are typically very heterogeneous, the shrinkage which occurs within the coal seam may be very uneven. The uneven shrinkage can exacerbate the cracking within the coal seam. This cracking can increase the permeability of the coal seam and may facilitate the creation of shear and tensile failure within the coal seam during cavitation.

Additionally, as methane is removed from the coal seam, the material properties of the coal, such as cohesion strength, may change. It is believed that the cohesion strength of the coal is reduced as methane is removed from the matrix. Furthermore, other volatiles, such as ethane and propane, together with water, are typically removed from the coal together with the methane. It is believed that the removal of these compounds from the coal also tends to reduce the cohesion strength of the coal which in turn makes the coal more friable. This reduction in cohesion strength of the coal will facilitate the creation of tensile and shear failure within the coal seam during cavitation of the coal seam surrounding the wellbore. As discussed earlier, tensile failure and shear failure created within a coal seam will increase the methane recovery rate from the well.

While this invention is susceptible of embodiment in many different forms, there will herein be described in detail, specific embodiments of the invention. It should be understood, however, that the present disclosure is to be considered an exemplification of the principles of the invention and is not intended to limit the invention to the specific embodiments illustrated.

Removal of Methane From the Coal Seam

Coal seams are comprised of carbonaceous material which includes a matrix having an extensive system of micropores, and a system of fractures, which penetrate the matrix, commonly referred to as "cleats." The majority of the methane contained in a typical coal seam is sorbed within the micropores of the coal. To remove the methane from the coal seam, several methods may be utilized.

One method useful for removing methane from a coal seam utilizes primary depletion to recover methane from the seam. In this method, as the reservoir pressure of the coal seam is lowered, the partial pressure of methane within the cleats decreases. This causes methane to desorb from the methane sorption sites and diffuse to the cleats. Once within the cleat system, the methane flows to a production well where it is recovered. The reservoir pressure continually decreases over time as methane is recovered from the coal seam. Also, the methane recovery rate tends to decrease over time as methane is recovered from the seam.

As discussed earlier, the carbonaceous matrix shrinks as methane is removed from the coal seam. This shrinkage will lower the stress within the coal seam and if the shrinkage is uneven may cause cracking within the coal seam. Also, it is believed that as the stress within the coal seam is reduced, the formation parting pressure of the coal seam is reduced. A reduction in formation parting pressure will allow tensile failures to be propagated more easily through the coal seam at a lower pressure. It is preferable to reduce the stress within the formation by a sufficient amount to lower the formation parting pressure by at least 20 percent prior to cavitating the coal seam; more preferably by at least 50 percent; and most preferably by at least 70 percent.

FIG. 1 is a graph of the failure envelope for a typical San Juan Basin coal. Shear stress is represented on the y-axis and effective normal stress is represented on the x-axis. The effective stresses are simply the stresses present within the coal minus the pore pressure ($P_p$) present within the coal. The cohesion strength of the coal seam can be determined from the point at which the lower bound of the failure envelope crosses the y-axis. The lower bound of the failure envelope is described by two lines 21 and 23. Lines 21 and 23 are used to describe the failure envelope due to the uncertainty in determining the lower bound of the failure envelope. Coals subjected to stresses which place them at or above the lower bound of the failure envelope are prone to failure. Also displayed on FIG. 1 are two Mohr circles 25 and 27 which graphically depict the stresses acting on the carbonaceous material of the coal seam. The first circle 25 depicts the stresses which act on the carbonaceous material of the coal seam before methane has been recovered from the coal seam. The second circle 27 depicts the stresses which act on the carbonaceous material of the coal seam after the reservoir pressure has been reduced by 519 p.s.i.

For Mohr circles, the right foot-point corresponds to effective overburden stress, $S_v-P_p$. The left foot-points of the Mohr circles corresponds to effective minimum horizontal stress, $S_{min}-P_p$. As methane is removed from the coal seam, reservoir pressure and pore pressure are decreased. Therefore, since the overburden stress is not changing, the right foot-point 29 of Mohr circle 27 is shifted to the fight compared to the right foot-point 31 of Mohr circle 25. The left foot-point 33 of Mohr circle 27 is believed to be shifted to the left compared to the left foot-point 35 of Mohr circle 25 because the minimum horizontal stress is reduced by the matrix shrinkage which occurs within the carbonaceous material as methane is desorbed from the matrix, and because for most coals the effective minimum horizontal stress will be reduced more by the shrinkage than it is increased by the decrease in pore pressure, as methane is desorbed from the matrix. As can be seen from FIG. 1, as methane is desorbed and pore pressure is reduced, a Mohr circle which represents the stresses acting on the coal moves closer to the failure envelope of the coal. This is represented on FIG. 1 by Mohr circle 27 being shifted up toward the failure envelope 21 as compared to Mohr circle 25. Failure is likely to occur once the Mohr circle touches or intersects the failure envelope. Even if the Mohr circle is close to the failure envelope but doesn't touch or intersect the failure envelope, the additional rapid change in pressure which occurs within the coal seam during cavitation and the stresses this change creates can cause failure within the coal seam.

The effective minimum horizontal stress can be approximated from the wellbore pressure measured at shut-in of the wellbore during fracturing of the coal. The approximation becomes more accurate as the fracture produced becomes smaller. Therefore, minifrae tests, which are known to one of ordinary skill in the art, are believed to be accurate predictors of effective minimum horizontal stress.

As discussed above, when a Mohr circle plotted for a given coal touches or crosses the failure envelope, it means that the conditions are such that the coal is prone to failure. In accordance with the current invention, after a substantial percentage of the methane has been removed from the coal seam, a cavitation process is used to rapidly change the pressure and exacerbate the failure within the coal surrounding the wellbore to create failure within the coal seam.

The relative amount of carbon dioxide sorbed to a coal matrix is believed to effect the amount of failure which occurs within a coal seam during the practice of the current invention. It is believed the greater the matrix shrinkage which occurs for a given reservoir pressure reduction and thereby pore pressure reduction, the higher the chance of failure occurring within the coal seam during the practice of the invention. Coal which contains carbon dioxide sorbed to the matrix will exhibit greater matrix shrinkage during the removal of gases from the coal than coal which does not contain carbon dioxide.

Figure 2:
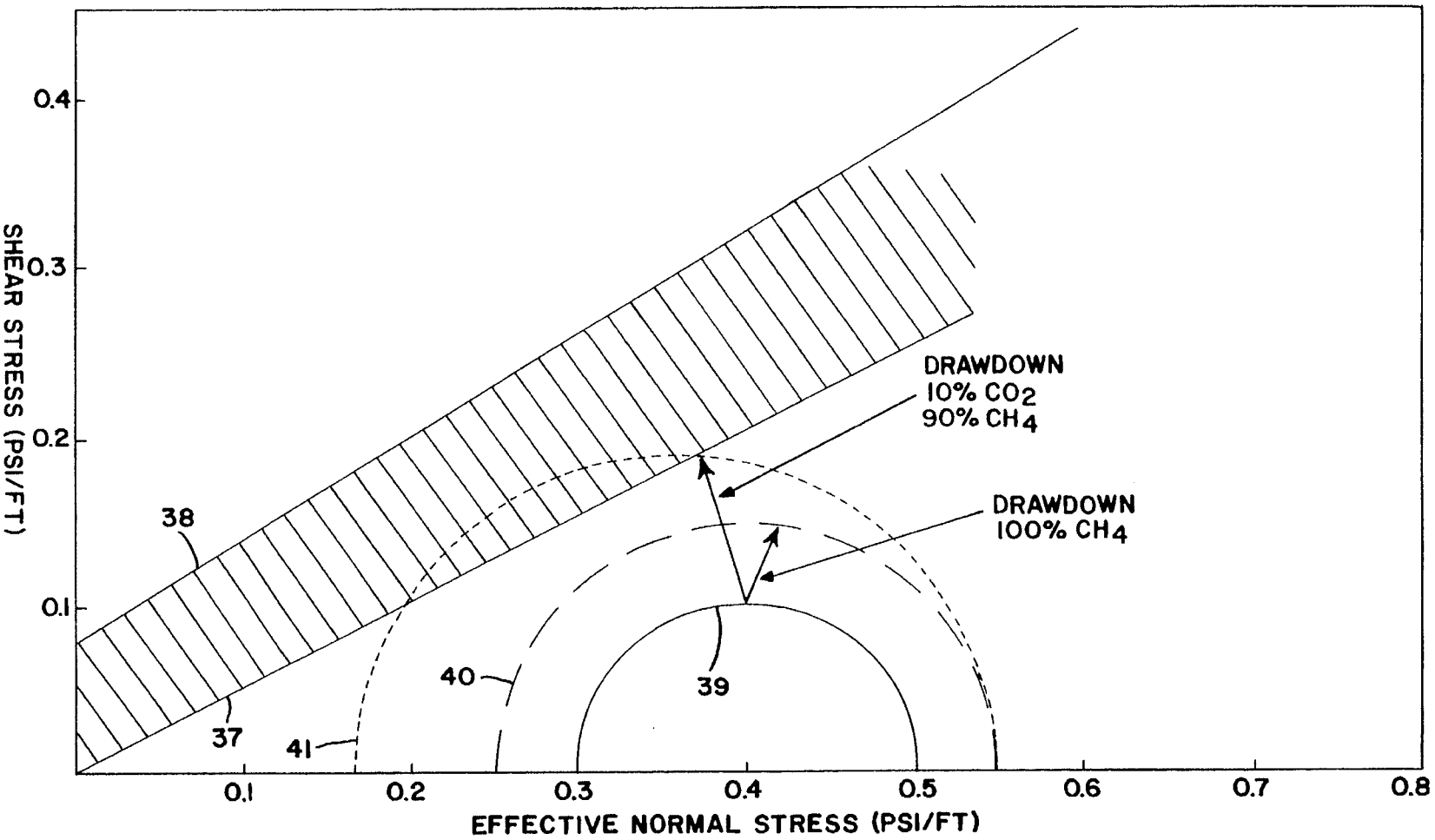
FIG. 2 is a graphical representation of the stresses associated with the failure of coal and the effect that carbon dioxide has on the failure of the coal.

Turning now to FIG. 2, the lower edge of the failure envelope is bounded by lines 37 and 38. Lines 37 and 38 are plotted due to the uncertainty of determining the lower edge of the failure envelope. As discussed earlier, coals which are subjected to stresses which place them at or above the lower bound of the failure envelope are prone to failure. Mohr circle 39 graphically depicts the stresses acting on a coal which contains a known quantity of original gas-in-place and a known initial pressure. Mohr circle 40 graphically depicts the stresses which will result within the coal if 100 percent by volume methane is withdrawn from the coal to reduce the pressure by 150 p.s.i. Mohr circle 41 graphically depicts the stresses which will result within the coal if an effluent is withdrawn from the coal which contains 90 percent by volume methane and 10 percent by volume carbon dioxide to reduce the pressure acting on the coal by 150 p.s.i. As can be seen from FIG. 2, for a given reduction in pore pressure, a coal seam which contains carbon dioxide and methane will be more prone to failure by pore pressure cracking than a coal seam which experiences a similar pore pressure reduction but which contains less carbon dioxide sorbed to the matrix. Therefore, when choosing wellbores to cavitate using the current invention, it is preferable to choose wells which are producing an effluent which contains greater than five percent by volume carbon dioxide; more preferably, greater than nine percent by volume carbon dioxide, most preferably greater than ten percent by volume carbon dioxide. This preference for wells that produce an effluent containing carbon dioxide is applicable to wellbores that are being produced using primary depletion techniques and enhanced coalbed methane recovery techniques which utilize inert gases such as nitrogen.

The percentage of original methane-in-place which remains within a coal seam is related to the isotherm for the coal and the change in reservoir pressure which has occurred since methane recovery was initiated. It has been found that before a well is stimulated in accordance with the invention, the reservoir pressure near the well should be preferably reduced to from 20 to 80 percent of the initial reservoir pressure which existed prior to methane being recovered from the coal seam; more preferably, from 30 to 75 percent of the initial reservoir pressure; and most preferably, from 36 to 59 percent of the initial reservoir pressure. This reduction in pressure and the associated recovery of methane from the coal seam will facilitate failure within the coal seam during cavitation of the coal seam surrounding the wellbore.

As discussed earlier, it is believed that the cohesion strength of the coal seam may be reduced by the removal of methane from the coal seam. This reduction in cohesion strength as it occurs, will result in the failure envelope moving toward to the Mohr circle, thereby making the carbonaceous material more prone to failure during the practice of the invention.

A discussion of a method which may be utilized to determine a failure envelope for coal is contained in "Experimental Observations of Hydraulic Fracture Propagation Through Coal Blocks", SPE 21289, by H. H. Abass et al., a paper presented at the Society of Petroleum Engineers Eastern Regional Meeting, Columbus, Ohio, Oct. 31 through Nov. 2, 1990.

It has been determined that the current invention is most effective when utilized on wells which have been producing greater than 100 thousand standard cubic feet of methane per day (MCFD) in the months prior to cavitation in accordance with the invention; preferably, greater than 500 MCFD; more preferably, greater than 1 million standard cubic feet of methane per day (MMCFD); and most preferably, greater than 2 MMCFD.

Another method which can be useful for desorbing methane from a coal seam utilizes the injection of a desorbing fluid, such as nitrogen, into a solid carbonaceous subterranean formation to enhance the recovery of methane from the formation. Such a method is described in U.S. Pat. No. 5,014,785 to Puri, et al., which is hereby incorporated by reference.

The injection of a desorbing fluid into the coal seam will lower the partial pressure of methane within the cleats of the coal seam and thereby cause methane to be desorbed from the coal seam. The desorbed methane will travel to a production well where it can be recovered. Studies have shown that one nitrogen molecule can sorb to the matrix for about every 2 to 2.5 methane molecules that desorb from the matrix. Therefore, the coal matrix will shrink as nitrogen displaces methane from the coal. It is believed a desorbing fluid, which contains components which will tend to swell the matrix, will still cause the matrix to shrink overall if the percentage of components that swell the matrix is not too large.

It is believed that the shrinkage that occurs, as a result of nitrogen injection, will facilitate the failure of the coal for reasons which are similar to those listed above for the recovery of methane by primary pressure depletion. Additionally, it is believed that methane recovery by the injection of desorbing fluid may change the material properties of the coal more than methane recovery by primary pressure depletion. This may result because of the drying of the coal which can result from the injection of desorbing fluid into the coal seam. Specifically, it is believed that the cohesion strength of the coal will be reduced. The lower cohesion strength which results, should make the coal more prone to failure during the practice of the current invention.

As with primary depletion, a substantial percentage of the original methane-in-place should be recovered from the coal seam prior to cavitating the coal seam surrounding the wellbore. Preferably, between 2 to 70 percent of the original methane-in-place available to the wellbore should be desorbed and removed from the coal seam surrounding the wellbore; more preferably, between 30 to 70 percent of the original methane in place; most preferably, between 30 to 50 percent.

By recovering a larger percentage of the original methane-in-place than was recovered using primary depletion, the benefits of the nitrogen injection and the increased recovery rate which results from the stimulation of the coal seam have been fully utilized.

A third method which can be useful for desorbing methane from a coal seam utilizes the injection of a desorbing fluid, which contains at least fifty percent by volume carbon dioxide, into the coal seam. A description of how these types of desorbing fluids can be used to enhance the recovery of methane from a formation are more fully in U.S. patent application Ser. No. 08/222,743, Attorney Docket Number 33,310, which is hereby incorporated by reference for its teachings relating to the recovery of methane from a coal seam.

It is believed that coal seams which have undergone enhanced recovery using carbon dioxide containing fluids are also likely to have had their material properties altered. Specifically, it is believed that the cohesion strength of the coal may be markedly reduced. This reduction in the cohesion strength will make it easier to create tensile and shear failure within a coal seam during the practice of the current invention as already discussed above. Also, fluids which contain carbon dioxide tend to cause carbonaceous materials, such as coal, to swell as methane is desorbed from the matrix and carbon dioxide is sorbed to the matrix. This swelling may be uneven and therefore may cause cracking within the coal.

As with enhanced recovery using nitrogen, when carbon dioxide containing fluids are utilized to recover methane, it is preferable to recover from 2 to 70 percent of the original methane-in-place available to the wellbore prior to cavitating the coal seam surrounding the wellbore in accordance with the current invention; more preferably, from 30 to 70 percent of the original methane-in-place; most preferably, from 30 to 50 percent of the original methane-in-place.

Since carbon dioxide causes the carbonaceous matrix of coal to swell, it is preferable to desorb some of the carbon dioxide from the coal prior to cavitating the coal seam surrounding the wellbore. This can be effectively done by relieving the pressure within the coal seam through the wellbore. It is believed that the pressure, preferably, should be relieved at a rate essentially equivalent to the maximum flow rate permitted by the wellbore and wellbore equipment. It should be noted that the wellbore and wellbore equipment utilized to carry out the invention may provide a higher fluid flow rate than that achievable when the wellbore is configured to send gas to commercial sales. By desorbing some of the carbon dioxide from the coal surrounding the wellbore, the amount of swelling caused by the carbon dioxide can be reduced. It is believed that this will assist in creating failure within the coal seam during the practice of the invention. Additionally, uneven shrinkage is believed to occur within the carbonaceous matrix of the coal seam as carbon dioxide is desorbed from the matrix. This uneven shrinking may cause cracking within the matrix which will make it easier to create tensile and shear failure within the coal seam during the cavitation of the coal seam surrounding the wellbore.

The Wellbore and Cavitation of the Coal Seam Surrounding Wellbore

In one aspect of the invention, the wellbore which is cavitated after a substantial percentage of the original methane-in-place has been recovered, is the same wellbore which was originally completed into the methane producing coal interval. "Same wellbore" means that the wellbore has not been sidetracked or redrilled at a nearby location. The cost effectiveness of the invention is greatly enhanced by using the same wellbore. It is also believed that in most circumstances, the highest methane recovery rate can be achieved by using the same wellbore.

In another aspect of the invention, the wellbore which is cavitated after a substantial percentage of the original methane is recovered from the coal seam may be a sidetracked wellbore or may be a newly drilled well which is closely located to the original wellbore. This may be done when it is impracticable to use the original wellbore. For example, if the formation directly adjacent to the original wellbore was greatly damaged by the original completion technique used, it would be preferable to sidetrack to create a new wellbore in the region of the coal seam or to drill a new well. Even if a new well or a sidetracked wellbore is utilized, it is believed that the wellbore should be located close enough to the original wellbore so that a substantial percentage of the original methane-in-place will have been recovered from the region of the coal seam which is to be drained by the new wellbore.

The cavitation may be accomplished by a variety of methods. For example, the cavitation can be effected by introducing a gaseous fluid, such as air, nitrogen, flue gas, or carbon dioxide into the coal seam in a series of injection/blowdown cycles which will tend to destabilize the coal seam and cause carbonaceous material to be released into the wellbore during blowdown. Additional shear failure will occur within the coal seam during blowdown. The failure will usually result in increased permeability within the formation adjacent the wellbore. The increase in permeability is believed to be greatest next to the wellbore and will taper off as one gets farther away from the wellbore. In an alternative method for cavitating the coal seam surrounding the wellbore, the wellbore is shut-in to allow the pressure within the wellbore to build-up. Once the wellbore pressure has reached a desired level, the wellbore is allowed to blowdown to the surface with minimal restriction. The differential pressure which is created during this type of blowdown will also cause shear failure within the coal seam. In general both injection/blowdown cycles and wellbore shut-ins are utilized in a typical cavitation procedure utilized by the current invention.

In another method which can be utilized to cavitate the coal seam, a first fluid, which sorbs to the coal, is introduced into the coal seam and allowed to sorb to the coal prior to a second fluid being introduced into the coal seam. The second fluid is introduced into the coal seam at a pressure greater than the formation parting pressure of the coal seam. After the second fluid is introduced into the coal seam, the pressure within the coal seam is relieved to create shear failure within the coal seam. Additional details regarding the method can be found in U.S. patent application Ser. No. 08/174,303, attorney docket number 33,301, which is hereby incorporated by reference. The procedure disclosed in U.S. patent application Ser. No. 08/174,303, attorney docket number 33,301 can be utilized to cavitate the coal seam surrounding wellbore intervals completed with cased-hole techniques and open-hole techniques.

When utilizing injection/blowdown cycles to cavitate a coal seam surrounding the wellbore, the fluid is typically injected for about 2 to 3 hours. As fluid is injected, the pressure within the formation increases rapidly and then begins to level off. It is believed that the leveling off of the pressure during injection occurs as the formation parting pressure is reached. It is believed that tensile failure is created within the coal seam as injection is continued at or above the formation parting pressure. It is believed that the formation parting pressure will be approximately 100 to 200 p.s.i. above the effective minimum horizontal stress present within the formation. Therefore, as methane is desorbed from the coal seam and minimum stress is reduced, the formation parting pressure will decrease. It is believed that the minimum stress can be further reduced by failure which is induced within the coal seam by each cavitation cycle. A reduced formation parting pressure can be advantageous because less compression is required to cavitate the coal seam. This reduced compression requirement should lower the costs associated with cavitating the coal seam surrounding the wellbore.

As discussed earlier, the wellbore is rapidly blown down to reduce the pressure within the coal seam surrounding the wellbore once the desired quantity of fluid has been injected into the formation. It is believed that shear failure is created during this blowdown. In order to maximize the shear failure which is created within the coal seam, the pressure is relieved at a rate essentially equivalent to the maximum flow-rate permitted by the wellbore and wellbore control equipment. If desired, the wellbore and wellbore control equipment utilized during cavitation can be modified to increase the rate of pressure reduction which can be obtained during blowdown. Typically, the pressure within the coal seam surrounding the wellbore will be reduced to approximately the reservoir pressure in less than one minute. During this time, the pressure within the bottom of the wellbore will be reduced to approximately atmospheric pressure plus the hydrostatic pressure within the wellbore which results from the column of gas within the wellbore. Coal fines, water, and methane are generally produced during the blowdown. The blowdown is typically continued until coal fines are no longer produced. The coal fines may continue to be produced for between several minutes to several days.

Periodically, a flow test which lasts approximately 2 hours should be performed. During the cavitation procedure, the methane flow rate will generally continue to rise as cavitation is occurring. The flow rate, however, may vary up or down between subsequent cycles. Because of the variance in the methane flow rate which may occur between subsequent cycles, a stable methane flow rate is preferably determined by comparing the methane flow rates from at least three consecutive cycles.

The cavitation is generally continued until a stable cavity is attained. When a stable cavity is attained, coal fines should no longer be produced during the blowdowns or during clean out of the wellbore or the amount of fines produced should be rapidly decreasing with subsequent blowdowns. A clean-out of the wellbore can be accomplished by circulating fluid through the wellbore. If required, a drillbit can also be rotated within the wellbore to aid in the clean out of the wellbore. In addition to attaining a stable cavity, it is also preferable that the methane flow rate be stabilized before ceasing to cavitate the coal seam. As discussed above, a stable methane flow rate should be determined from measuring the flow rate from three consecutive cavitation cycles. Preferably, the methane flow rate from three consecutive flow tests should differ no more than 5–10 percent from the highest rate to the lowest rate obtained from the three consecutive tests; more preferably, no more than 1–5 percent; most preferably, no more than 2 percent.

Modifications to wellbore and wellbore control equipment which can be utilized to cavitate the coal seam surrounding a wellbore are more fully described in SPE 24906, "Openhole Cavity Completions in Coalbed Methane Wells in the San Juan Basin", by I. D. Palmer et. al, a paper presented at the 67th Annual Technical Conference and Exhibition of the Society of Petroleum Engineers held in Washington, D.C. Oct. 4–7, 1992, which is hereby incorporated by reference for its disclosure relating to the equipment which can be utilized to cavitate the coal seam surrounding a wellbore.

Once the cavitation procedure is completed, the well can be realigned so that the methane produced can be recovered. Typically, the methane recovered from the well will be sent to a pipeline.

EXAMPLE 1

This example shows that it is possible to more than triple the methane recovery rate from a wellbore using the current invention.

Figure 3:
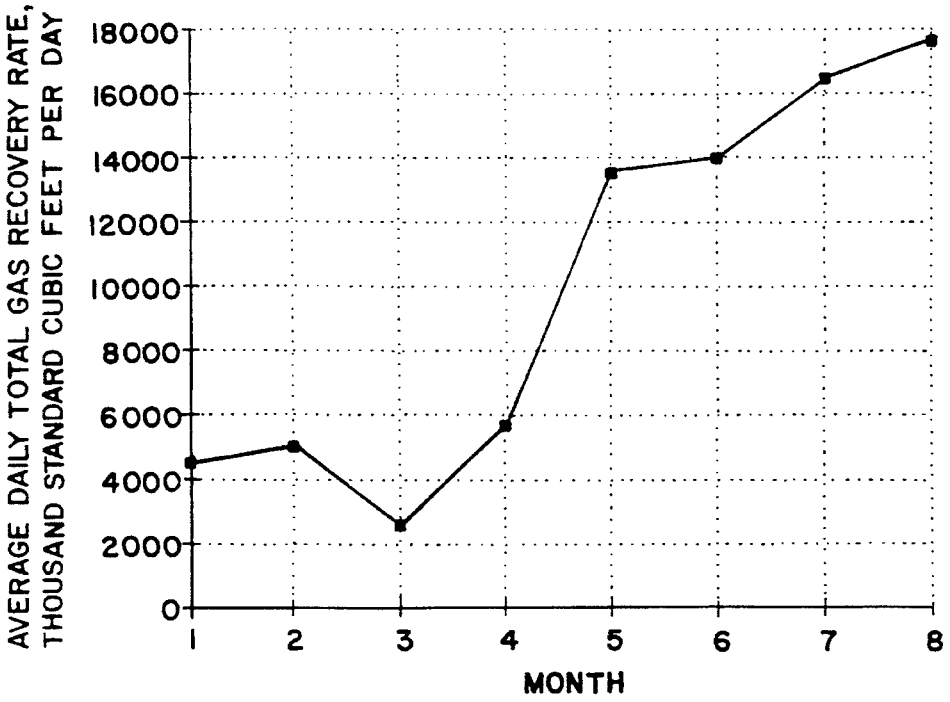
FIG. 3 is a graph of the average daily total gas recovery rate from a wellbore which penetrates a coal seam which has been recavitated using the current invention.

Referring to FIG. 3, a wellbore was drilled into the fruitland formation coals of the San Juan Basin of New Mexico. The wellbore was initially completed using an open-hole cavity completion technique. The initial reservoir pressure near the wellbore, before methane was recovered from the wellbore, was approximately 1600 p.s.i. During the initial completion, the water production rate was approximately 2000 barrels per day. The high water production rate limited the amount of cavitation which could be performed on the well. Once the wellbore was completed, it was aligned to recover methane from the formation by primary pressure depletion through 2.38 inch diameter tubing. For approximately three years, methane was recovered from the wellbore by primary pressure depletion. During the three year period, approximately 10 percent of the original methane-in-place was recovered from the wellbore. After the three year period, the wellbore was taken off line and recavitated. During the recavitation, the water production rate had decreased substantially, indicating that the coal seam surrounding the wellbore had been significantly dewatered. During the recavitation, the reservoir pressure was estimated to be about 1000 p.s.i. The recavitation was continued until a stable cavity was attained. Once a stable cavity was attained, the wellbore was realigned to recover methane from the formation by primary pressure depletion through 4.5 inch diameter tubing.

FIG. 3 is a graphical representation of the total gas recovery rate from the wellbore. The average daily total gas recovery rate is depicted for the calender months preceding and following the recavitation of the wellbore. The gas recovered from the wellbore contained approximately 90 percent by volume methane and approximately 10 percent by volume carbon dioxide both before and after the recavitation. For months 1 and 2 shown, the average daily total gas recovery-rate was approximately 4.5 million standard cubic feet per day. The wellbore was taken off-line on about the 17th day of month three and therefore the average daily total gas recovery rate as depicted for month three is reduced. The wellbore was realigned to send gas to the pipeline on about the 15th day of month four.

As can be seen from FIG. 3, by month eight, the average daily total gas recovery rate was approximately 17.5 million standard cubic feet per day.

EXAMPLE 2

Figure 4:
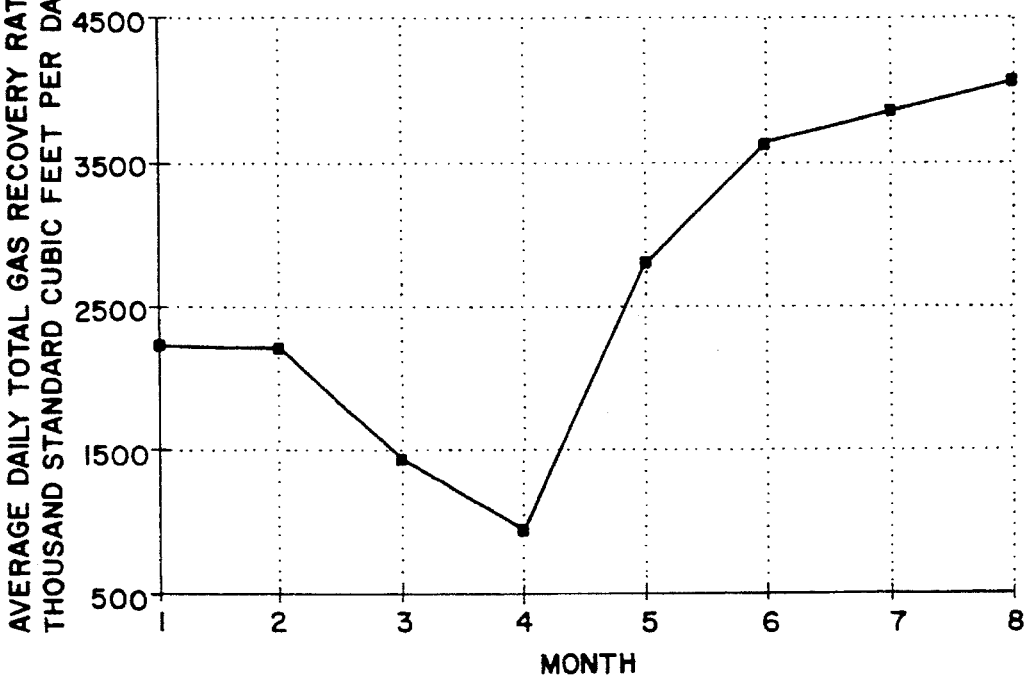
FIG. 4 is a graph of the average daily total gas recovery rate :from another wellbore which penetrates a coal seam which has been recavitated using the current invention.

Referring to FIG. 4, a wellbore was drilled into the fruitland formation coals of the San Juan Basin of New Mexico. The wellbore was initially completed using a cased-hole technique. An initial gasflow rate test to the atmosphere, which produced less than one percent of the original methane-in-place, was unsatisfactory. A decision was made to sidetrack the original wellbore and to create an open-hole cavity within the formation before the wellbore was put on-line to sales. The new wellbore was also sidetracked into the fruitland formation coals of the San Juan Basin of New Mexico. The sidetracked wellbore was completed using an open-hole cavity completion technique. The initial reservoir pressure near the sidetracked wellbore was approximately 1150 p.s.i. During the initial cavity completion, the completion rig was removed from the wellbore without determining whether a stable cavity was attained.

Once the sidetracked wellbore was completed, it was aligned to recover methane from the formation by primary pressure depletion through 2.38 inch diameter tubing. For approximately two years, methane was recovered from the wellbore by primary pressure depletion. During the two year period, approximately 12 percent of the original methane-in-place was recovered from the wellbore. After the two year period, the wellbore was taken off line and recavitated. During the recavitation, the reservoir pressure was estimated to be about 696 p.s.i. The recavitation was continued until a stable cavity was attained. Once a stable cavity was attained, the wellbore was realigned to recover methane from the formation by primary pressure depletion through 3.5 inch diameter tubing.

FIG. 4 is a graphical representation of the total gas recovery rate from the wellbore. The average daily total gas recovery rate is depicted for the calender months preceding and following the recavitation of the wellbore. The gas recovered from the wellbore contained approximately 91.5 percent by volume methane and approximately 9.5 percent by volume carbon dioxide both before and after the recavitation. For months 1 and 2 shown, the average daily total gas recovery-rate was approximately 2 million standard cubic feet per day. The wellbore was taken off-line on about the 28th day of month three and therefore the average daily total gas recovery rate as depicted for month three is reduced. The wellbore was realigned to send gas to the pipeline on about the 25th day of the month four.

As can be seen from FIG. 4, by month eight, the average daily total gas recovery rate was approximately 4 million standard cubic feet per day.

EXAMPLE 3

Figure 5:
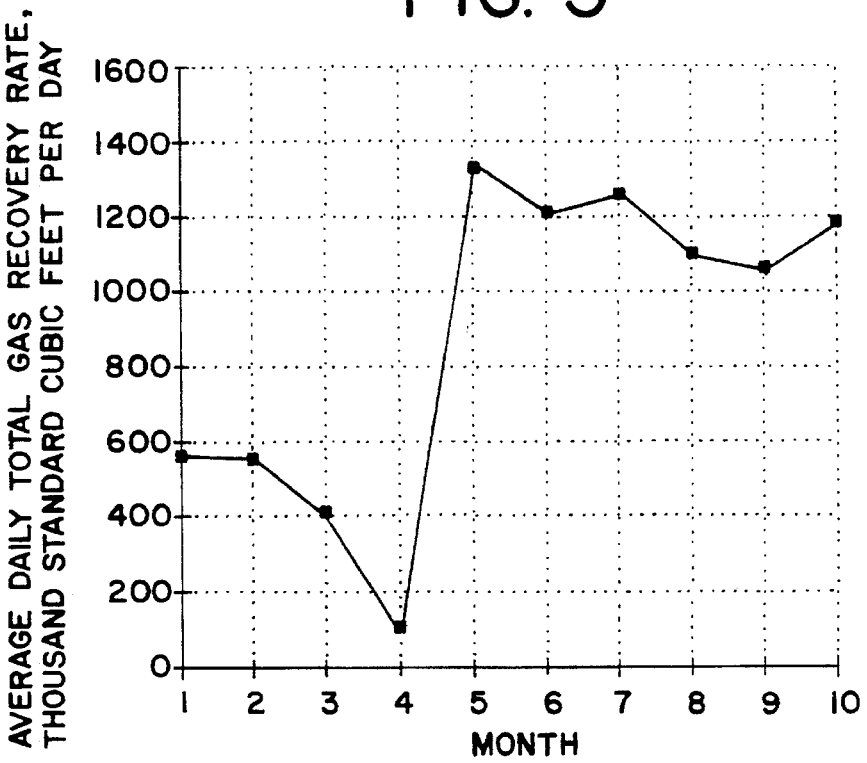
FIG. 5 is a graph of the average daily total gas recovery rate from a third wellbore which penetrates a coal seam which has been recavitated using the current invention.

Referring to FIG. 5, a wellbore was drilled into the fruitland formation coals of the San Juan Basin of New Mexico. The wellbore was initially completed using an open-hole cavity completion technique. The initial reservoir pressure near the wellbore, before methane was recovered from the wellbore, was approximately 1040 p.s.i. During the initial cavity completion, the completion rig was removed from the wellbore without determining whether a stable cavity was attained.

Once the wellbore was completed, the wellbore was aligned to recover methane from the formation by primary pressure depletion through 2.38 inch diameter tubing. For approximately two years, methane was recovered from the wellbore by primary pressure depletion. During the two year period, approximately 2 percent of the original methane-in-place was recovered from the wellbore. After the two year period, the wellbore was taken off line and recavitated. During the recavitation, the reservoir pressure was estimated to be about 760 p.s.i. The recavitation was continued until a stable cavity was attained. Once a stable cavity was attained, the wellbore was realigned to recover methane from the formation by primary pressure depletion through 2.88 inch diameter tubing.

FIG. 5 is a graphical representation of the total gas recovery rate from the wellbore. The average daily total gas recovery rate is depicted for the calender months preceding and following the recavitation of the wellbore. The gas recovered from the wellbore contained approximately 91 percent by volume methane and approximately 9 percent by volume carbon dioxide both before and after the recavitation. For months 1 and 2 shown, the average daily total gas recovery-rate was approximately 500 to 600 thousand standard cubic feet per day. The wellbore was taken off-line on about the 23th day of month three and therefore the average daily total gas recovery rate as depicted for month three is reduced. The wellbore was realigned to send gas to the pipeline on about the 29th day of the month four.

As can be seen from FIG. 5, by month ten, the average daily total gas recovery rate was approximately 1.2 million standard cubic feet per day.

EXAMPLE 4

Figure 6:
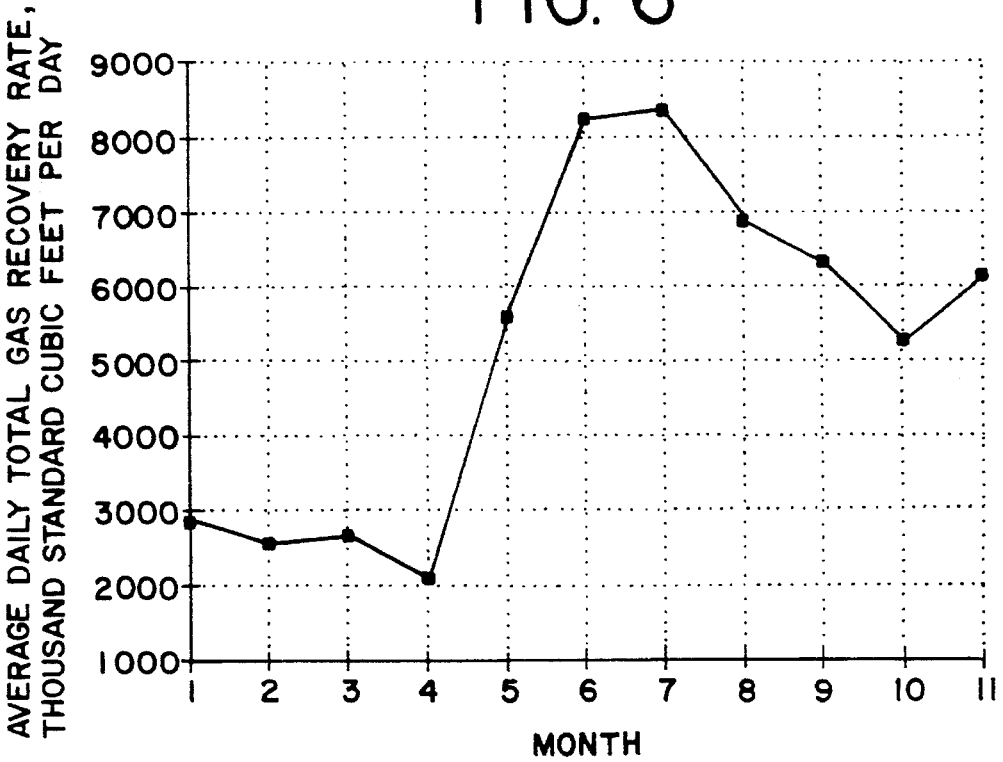
FIG. 6 is a graph of the average daily total gas recovery rate from a fourth wellbore which penetrates a coal seam which has been recavitated using the current invention.

Referring to FIG. 6, a wellbore was drilled into the fruitland formation coals of the San Juan Basin of New Mexico. The wellbore was initially completed using an open-hole cavity completion technique. Once the wellbore was completed, it was aligned to recover methane from the formation by primary pressure depletion. The wellbore was taken off line and recavitated after approximately 4 percent of the original methane-in-place had been recovered from the wellbore. The recavitation was continued until a stable cavity was attained. Once a stable cavity was attained, the wellbore was realigned to recover methane from the formation by primary pressure depletion.

FIG. 6 is a graphical representation of the total gas recovery rate from the wellbore. The average daily total gas recovery rate is depicted for the calender months preceding and following the recavitation of the wellbore. The gas recovered from the wellbore contained approximately 91.4 percent by volume methane and approximately 8.6 percent by volume carbon dioxide both before and after the recavitation. For months 1 to 3 shown, the average daily total gas recovery-rate was approximately 2.8 million standard cubic feet per day. The wellbore was taken off-line on about the 8th day of month four and therefore the average daily total gas recovery rate as depicted for month four is reduced. The wellbore was realigned to send gas to the pipeline on about the 11th day of month five.

As can be seen from FIG. 6, by month eleven, the average daily total gas recovery rate was approximately 6 million standard cubic feet per day.

EXAMPLE 5

Figure 7:
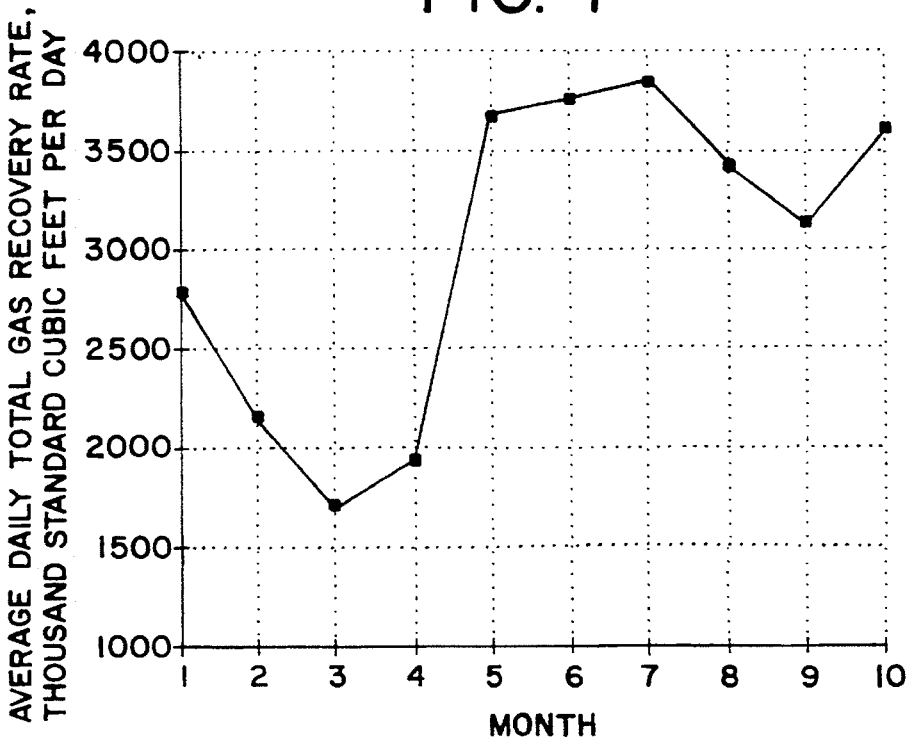
FIG. 7 is a graph of the average daily total gas recovery rate from a fifth wellbore which penetrates a coal seam which has been recavitated using the current invention.

Referring to FIG. 7, a wellbore was drilled into the fruitland formation coals of the San Juan Basin of New Mexico. The wellbore was initially completed using an open-hole cavity completion technique. Once the wellbore was completed, it was aligned to recover methane from the formation by primary pressure depletion. The wellbore was taken off line and recavitated after approximately 19 percent of the original methane-in-place had been recovered from the wellbore. The recavitation was continued until a stable cavity was attained. Once a stable cavity was attained, the wellbore was realigned to recover methane from the formation by primary pressure depletion.

FIG. 7 is a graphical representation of the total gas recovery rate from the wellbore. The average daily total gas recovery rate is depicted for the calender months preceding and following the recavitation of the wellbore. The gas recovered from the wellbore contained approximately 90.4 percent by volume methane and approximately 9.6 percent by volume carbon dioxide both before and after the recavitation. For months 1 and 2 shown, the average daily total gas recovery-rate was approximately 2.5 million standard cubic feet per day. The wellbore was taken off-line on about the 24th day of month three and therefore the average daily total gas recovery rate as depicted for month three is reduced. The wellbore was realigned to send gas to the pipeline on about the 11th day of month four.

As can be seen from FIG. 7, by month ten, the average daily total gas recovery rate was approximately 3.6 million standard cubic feet per day.

EXAMPLE 6

Figure 8:
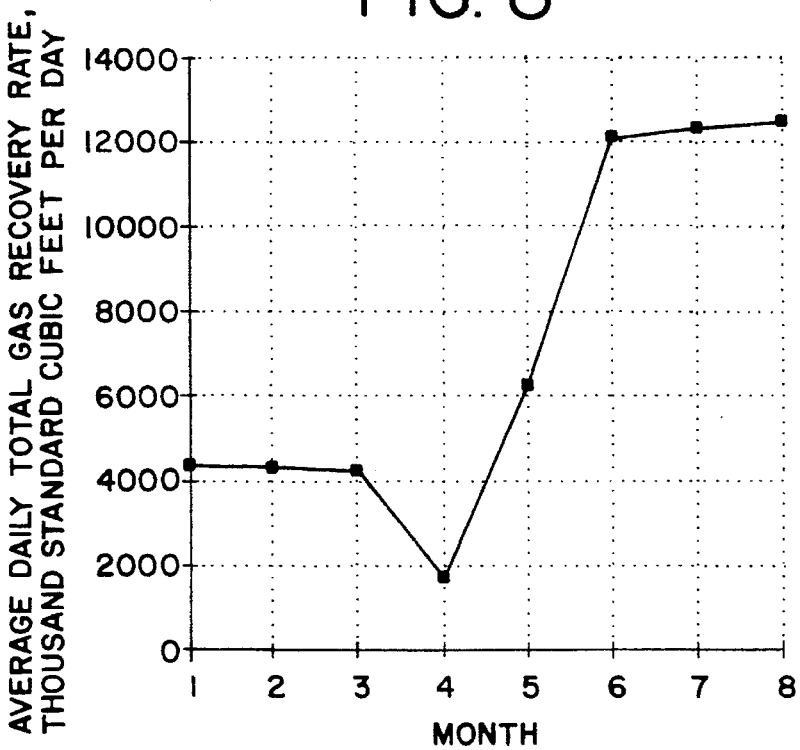
FIG. 8 is a graph of the average daily total gas recovery rate from a sixth wellbore which penetrates a coal seam which has been recavitated using the current invention.

Referring to FIG. 8, a wellbore was drilled into the fruitland formation coals of the San Juan Basin of New Mexico. The wellbore was initially completed using an open-hole cavity completion technique. Once the wellbore was completed, it was aligned to recover methane from the formation by primary pressure depletion. The wellbore was taken off line and recavitated after approximately 5 percent of the original methane-in-place had been recovered from the wellbore. The recavitation was continued until a stable cavity was attained. Once a stable cavity was attained, the wellbore was realigned to recover methane from the formation by primary pressure depletion.

FIG. 8 is a graphical representation of the total gas recovery rate from the wellbore. The average daily total gas recovery rate is depicted for the calender months preceding and following the recavitation of the wellbore. The gas recovered from the wellbore contained approximately 91.7 percent by volume methane and approximately 8.3 percent by volume carbon dioxide both before and after the recavitation. For months 1 to 3 shown, the average daily total gas recovery-rate was approximately 4.1 million standard cubic feet per day. The wellbore was taken off-line on about the 12th day of month four and therefore the average daily total gas recovery rate as depicted for month four is reduced. The wellbore was realigned to send gas to the pipeline on about the 12th day of the fifth month.

As can be seen from FIG. 8, by month eight, the average daily total gas recovery rate was approximately 12 million standard cubic feet per day.

EXAMPLE 7

Figure 9:
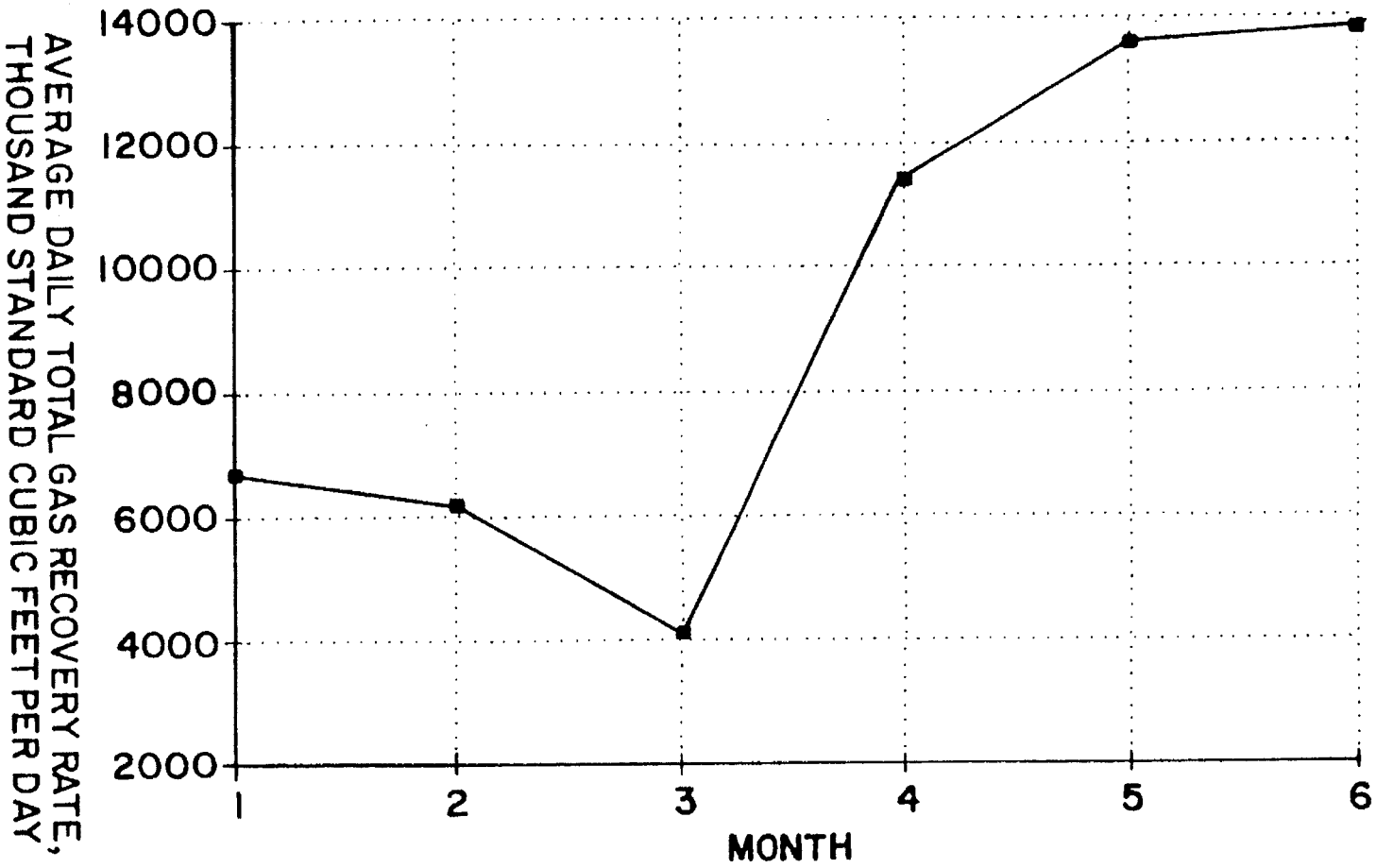
FIG. 9 is a graph of the average daily total gas recovery rate from a seventh wellbore which penetrates a coal seam which has been recavitated using the current invention.

Referring to FIG. 9, a wellbore was drilled into the fruitland formation coals of the San Juan Basin of New Mexico. The wellbore was initially completed using an open-hole cavity completion technique. Once the wellbore was completed, it was aligned to recover methane from the formation by primary pressure depletion. The wellbore was taken off line and recavitated after approximately 30 percent of the original methane-in-place had been recovered from the wellbore. The recavitation was continued until a stable cavity was attained. Once a stable cavity was attained, the wellbore was realigned to recover methane from the formation by primary pressure depletion.

FIG. 9 is a graphical representation of the total gas recovery rate from the wellbore. The average daily total gas-recovery rate is depicted for the calender months preceding and following the recavitation of the wellbore. The gas recovered from the wellbore contained approximately 87.7 percent by volume methane and approximately 12.3 percent by volume carbon dioxide both before and after the recavitation. For months 1 and 2 shown, the average daily total gas recovery-rate was approximately 6.2 million standard cubic feet per day. The wellbore was taken off-line on about the 12th day of month three and therefore the average daily total gas recovery rate as depicted for month three is reduced. The wellbore was realigned to send gas to the pipeline on about the 8th day of month four.

As can be seen from FIG. 9, by month six, the average daily total gas recovery rate was approximately 12 million standard cubic feet per day.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made and materials may be substituted for those described in the application. For example, it is believed that the conditions, parameters, and techniques described in the application can be utilized to increase the methane recovery rate from other solid carbonaceous subterranean formations, such as antrium, carbonaceous, and devonian shales. Also, it is believed that the effectiveness of other stimulation techniques, such as fracture stimulation, can be enhanced by establishing the conditions and parameters discussed in this application prior to fracture stimulating a solid carbonaceous subterranean formation, such as a coal seam.

Thus, it will be appreciated that various modifications, alternatives, variations, etc., may be made without departing from the spirit and scope of the invention as defined in the appended claims. It is, of course, intended that all such modifications are covered by the appended claims.

We claim:

1. A method for increasing the methane recovery rate from a well which drains methane from a region of a coal seam, the method comprising the steps of:

a) recovering a sufficient quantity of an effluent, containing methane, from the coal seam to reduce the formation parting pressure of the region of the coal seam drained by the well by at least 20% of the initial formation parting pressure; and thereafter b) cavitating the coal seam surrounding a wellbore which penetrates the region of the coal seam drained by the well.

2. The method of claim 1, wherein step b) comprises:

ba) shutting in the wellbore to cause the pressure within the coal seam surrounding the wellbore to increase; thereafter bb) relieving the pressure within the coal seam through the wellbore; and bc) repeating steps ba) and bb).

3. The method of claim 2, wherein the pressure relieved in step bb) is relieved at a rate essentially equivalent to a maximum flow rate permitted by the wellbore and wellbore equipment.

4. The method of claim 1, wherein a sufficient quantity of the effluent is recovered in step a) to reduce the formation parting pressure by at least 50% of the initial formation parting pressure.

5. The method of claim 1, wherein step b) comprises:

ba) introducing a gaseous fluid into the coal seam through the wellbore at a pressure above the reservoir pressure of the coal seam;

bb) relieving the pressure within the coal seam surrounding the wellbore through the wellbore; and bc) repeating steps ba) and bb).

6. The method of claim 5, wherein the gaseous fluid introduced in step ba) comprises air.

7. The method of claim 1, wherein the wellbore of step b) is created by sidetracking an original wellbore used to recover the effluent in step a).

8. The method of claim 1, wherein the effluent recovered in step a) contains at least about 5 volume percent carbon dioxide.

9. The method of claim 1, wherein the effluent recovered in step a) contains at least about 9 volume percent carbon dioxide.

10. The method of claim 1, wherein the recovery of the effluent in step a) is facilitated by the injection of a fluid containing nitrogen into the coal seam.

11. The method of claim 1, wherein the recovery of the effluent in step a) is facilitated by the injection of air into the coal seam.

12. The method of claim 1, wherein the recovery of the effluent in step a) is facilitated by the injection of a fluid containing carbon dioxide into the coal seam.

13. The method of claim 1, wherein the recovery of the effluent in step a) is facilitated by the injection of flue gas into the coal seam.

* * * * *

UNITED STATES PATENT AND TRADEMARK OFFICE

CERTIFICATE OF CORRECTION

PATENT NO. : 5,494,108

DATED : February 27, 1996

INVENTOR(S) : Ian D. Palmer, Paul Edwards

It is certified that error appears in the above-indentified patent and that said Letters Patent is hereby corrected as shown below:

| Col. | Line | |
|---|---|---|
| 2 | 17-18 | "to open a coal seam and propagate ;an induced fracture" should read --to open a coal seam and propagate an induced fracture-- |
| 5 | 25 | "Mohr circle 27 is shifted to the fight" should read --Mohr circle 27 is shifted to the right-- |
| 5 | 52 | "minifrae tests," should read --minifrac tests,-- |

Signed and Sealed this

Twenty-fifth Day of June, 1996

Bruce Lehman

*Attest:*

BRUCE LEHMAN

*Attesting Officer*

*Commissioner of Patents and Trademarks*